US006832895B2

(12) United States Patent
Yoshioka et al.

(10) Patent No.: US 6,832,895 B2
(45) Date of Patent: Dec. 21, 2004

(54) LIGHT SHIELD FAN

(75) Inventors: Koji Yoshioka, Oita (JP); Shoji Kawahara, Okayama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 44 days.

(21) Appl. No.: 10/303,755

(22) Filed: Nov. 26, 2002

(65) Prior Publication Data

US 2003/0108420 A1 Jun. 12, 2003

(30) Foreign Application Priority Data

Nov. 27, 2001 (JP) ..... 2001-360569

(51) Int. Cl.[7] ..... F01D 1/02
(52) U.S. Cl. ..... 416/183; 416/198 R
(58) Field of Search ..... 416/183, 198 R, 416/200 R, 212 R, 214 R, 207, 208; 362/96, 101, 218, 294, 345, 364, 373, 437

(56) References Cited

U.S. PATENT DOCUMENTS 4,489,366 A * 12/1984 Rozniecki ..... 362/270
6,572,336 B2 * 6/2003 Horng et al. ..... 416/183

FOREIGN PATENT DOCUMENTS

JP 11-167166 6/1999

* cited by examiner

*Primary Examiner*—Edward K. Look
*Assistant Examiner*—Igor Kershteyn
(74) *Attorney, Agent, or Firm*—Wenderoth, Lind & Ponack, L.L.P.

(57) ABSTRACT

A cooling fan acts as a light shield to block light from shining therethrough, and also provides good air circulation. An impeller, which is a key constituent component of the fan, is split into a front stage impeller and a rear stage impeller. The front stage impeller has front stage blades, and the rear stage impeller has rear stage blades. Each of the front stage blades overlaps with the adjacent blades of the rear stage blades so as to cover the gaps between the sides of the rear stage blades. With this arrangement, the incident light beams are blocked by the blades, and also the constituent components can be released easily from the dies after molding. Still further, the air circulating characteristic is not degraded in the light shield fan of the present invention.

17 Claims, 8 Drawing Sheets

LIGHT SHIELD FAN

FIELD OF THE INVENTION

The present invention relates to a cooling fan for use in a projector or the like apparatus incorporating a light source, wherein the cooling fan cools the inside of the apparatus while shielding (blocking) the inside light of the light source from shining through the fan.

BACKGROUND OF THE INVENTION

The temperature inside a projector or the like apparatus incorporating a light source becomes high as a result of heat generation by the light source. In order to insure the safe operation, most of such apparatus are provided with a cooling fan in the cabinet, which fan cools the apparatus by circulating the ambient air in the cabinet.

In the first place, a commonly-used projector and a conventional cooling fan used in the projector are described with reference to FIG. 6 through FIG. 8. FIG. 6 is a cross-sectional view showing the outline of a conventional projector. FIG. 7 is a plan view of a conventional cooling fan for a projector. FIG. 8 shows a perspective view of an impeller of the conventional cooling fan.

Referring to FIG. 6, a projector 1 comprises a light source lamp unit 2, optical projection units 3 and 4, and a cooling fan 5. The cooling fan 5 is disposed behind the light source lamp unit 2, and a casing 6 is provided with exhaust holes 7 at a place corresponding to the cooling fan 5.

The cooling fan 5 has a housing 8 provided with an impeller opening 9. A motor (not shown) and an impeller 10 driven by the motor are disposed in the opening 9, as shown in FIG. 7. The impeller 10 is provided with a plurality of blades 11 protruding from an outer circumference of a boss portion 15. There are empty spaces (or gaps) 16 between the adjacent blades 11, as shown in FIGS. 7 and 8, which are provided for the purpose of easy separation of the impeller 10 from the dies after molding.

Not all of the light generated from the light source lamp unit 2 shines through the optical projection units 3 and 4 towards a screen (not shown). Rather, part of the light radiates to places other than the optical projection units 3 and 4. The light beams radiating to places other than the optical projection units 3 and 4 proceed through the gaps 16 between the blades 11 of the cooling fan 5, to eventually leak rearwardly out of the housing 8 through exhaust holes 7. This leaking of light beams rearwardly is annoying to persons viewing projected images who are sitting behind the projector 1. Effective measures for improving the above drawback have long been requested.

The gaps 16 between adjacent blades 11 of the impeller 10 could be narrowed, or even totally eliminated. But this would cause other difficulties related to manufacturing the impellers 10; namely, such impellers would be difficult to separate from the dies after molding, and would thus require an increased number of process steps.

Besides the above-described means for improvement, there have been other proposals. Namely, instead of providing the cooling fan 5 with a light shielding means, it has been proposed to provide a light shielding member in front, or behind, the cooling fan 5 (Japanese Patent No. JP 11167166A2 represents an example of such proposals). However, a light shielding member disposed in the front, or behind, the cooling fan 5 generally disadvantageously affects circulation of the air. This not only retards the cooling effect but it also tends to result in an increased number of parts in the apparatus, as well as increased assembly process steps.

SUMMARY OF THE INVENTION

The present invention addresses the above-described problems with the conventional cooling fans used in projectors or the like apparatus, and aims to offer such a cooling fan that has a light shielding property in itself, yet has an air handling capacity for circulating the cooling air that is not degraded. Furthermore, the constituent components of the fan, such as impeller, blades, etc., can be released easily from the dies after they are manufactured in a molding process.

A light shield fan of the present invention, which takes the air in at one end and exhausts it at the other end, comprises a housing, an impeller and a motor. The housing is provided with an impeller part having an opening for the impeller, and the impeller and the motor are disposed in the opening. The impeller comprises a plurality of blades provided along the outer circumference of a boss portion, and the blades appear overlapped with each other as viewed from the one end of the fan so that the incident light upon the one end of the fan is blocked thereby. The plurality of blades are radially extended from the boss portion of the impeller. Integration of these structures cancels the gaps formed between the sides of the blades, and light beams coming from the front are blocked by the blades.

In the light shield fan of the present invention, the plurality of blades on the circumference of the impeller is comprised of blades disposed at the intake side, or front stage blades, and blades disposed at the exhaust side, or rear stage blades. The front stage blades have an almost flat contour, while the rear stage blades are curved. There are gaps between the adjacent blades of the rear stage blades, and the gaps are overlapped by front stage blades so that the incident light coming from the one end of the fan is blocked. With the above-described structure, incident light from the front can be blocked at the impeller, while the fan's air sending (or circulating) characteristic is not degraded. Thus the fan is ideal for use in projectors or the like apparatus incorporating a light source.

In a light shield fan in the present invention, the impeller is split into a front stage impeller having the front stage blades and a rear stage impeller having the rear stage blades. The front stage impeller and the rear stage impeller are integrated into a single component by a connecting member. With the above-described structure, the light coming from the front is blocked at the impeller, and the constituent components forming the impeller can be released easily from the dies after molding, while the air circulating characteristic of the fan is not degraded. Thus the fan is ideal for use in projectors or the like apparatus incorporating a light source.

In the light shield fan of the present invention, the inner diameter of the impeller opening in the housing is narrowed so that the inner diameter at the edge at the rear stage impeller side (i.e. at the rear edge) is smaller than that at the front stage impeller side (i.e. at the front edge). Narrowing of the opening's inner diameter may be formed with either a sloped surface or a stepped shape. Furthermore, the inner diameter of the opening at the rear edge is at least 50% of that at the front edge. With the above-described structure, the light at the outer circumferential region of the blades can also be blocked. Thus the fan is ideal for use in projectors or the like apparatus incorporating a light source.

DETAILED DESCRIPTION OF THE INVENTION

Referring to FIG. 1 through FIG. 5, a light shield cooling fan in accordance with the present invention is described in detail.

Figure 1:
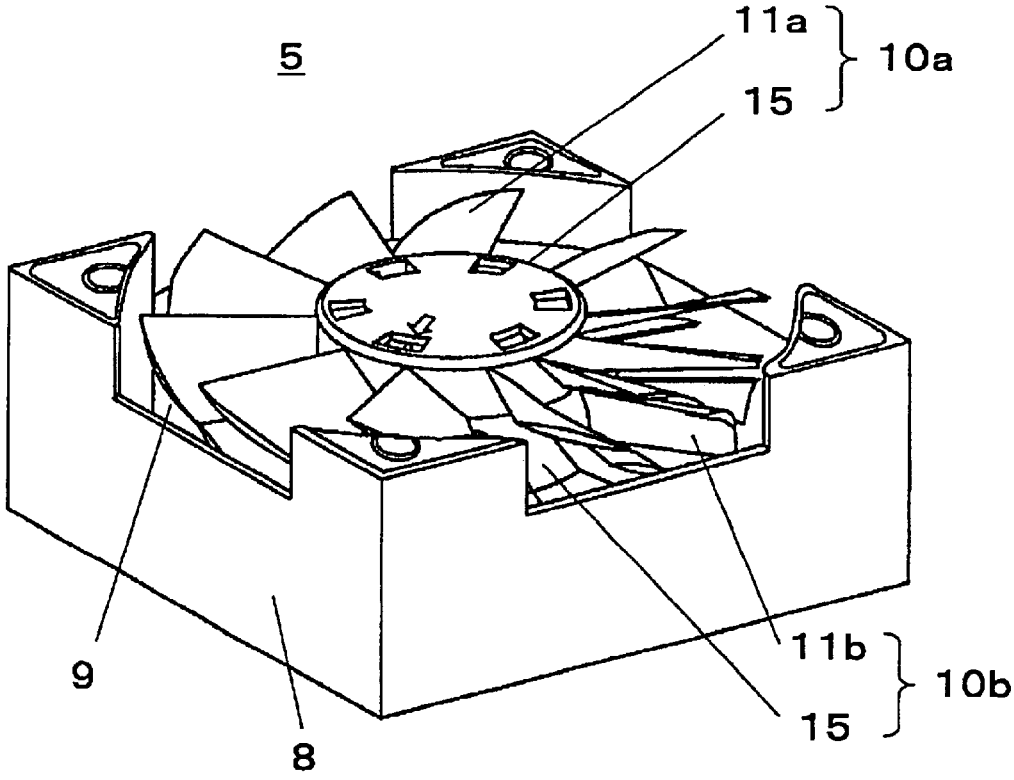
FIG. 1 is a perspective view of a light shield cooling fan in accordance with an exemplary embodiment of the present invention.
Figure 2:
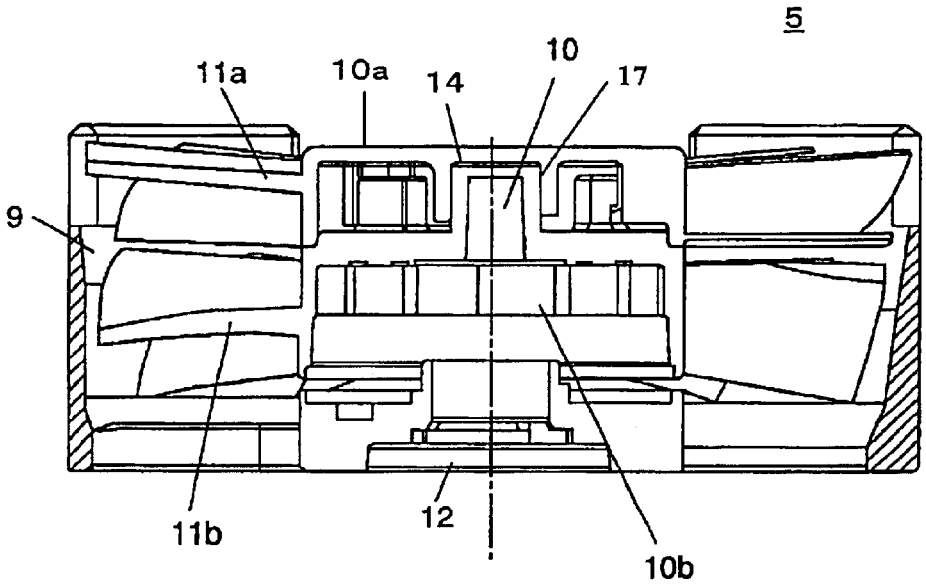
FIG. 2 is a cross-sectional view of the light shield cooling fan.
Figure 3:
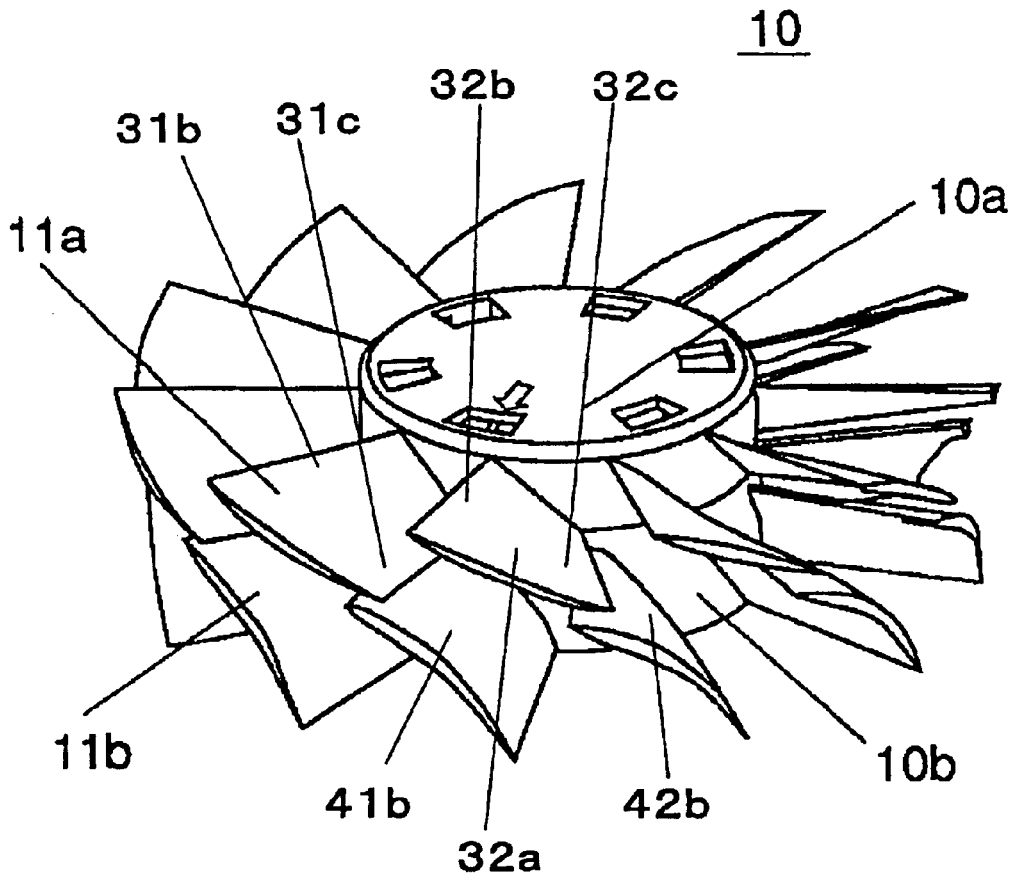
FIG. 3 is a perspective view showing an impeller of the light shield cooling fan.
Figure 4:
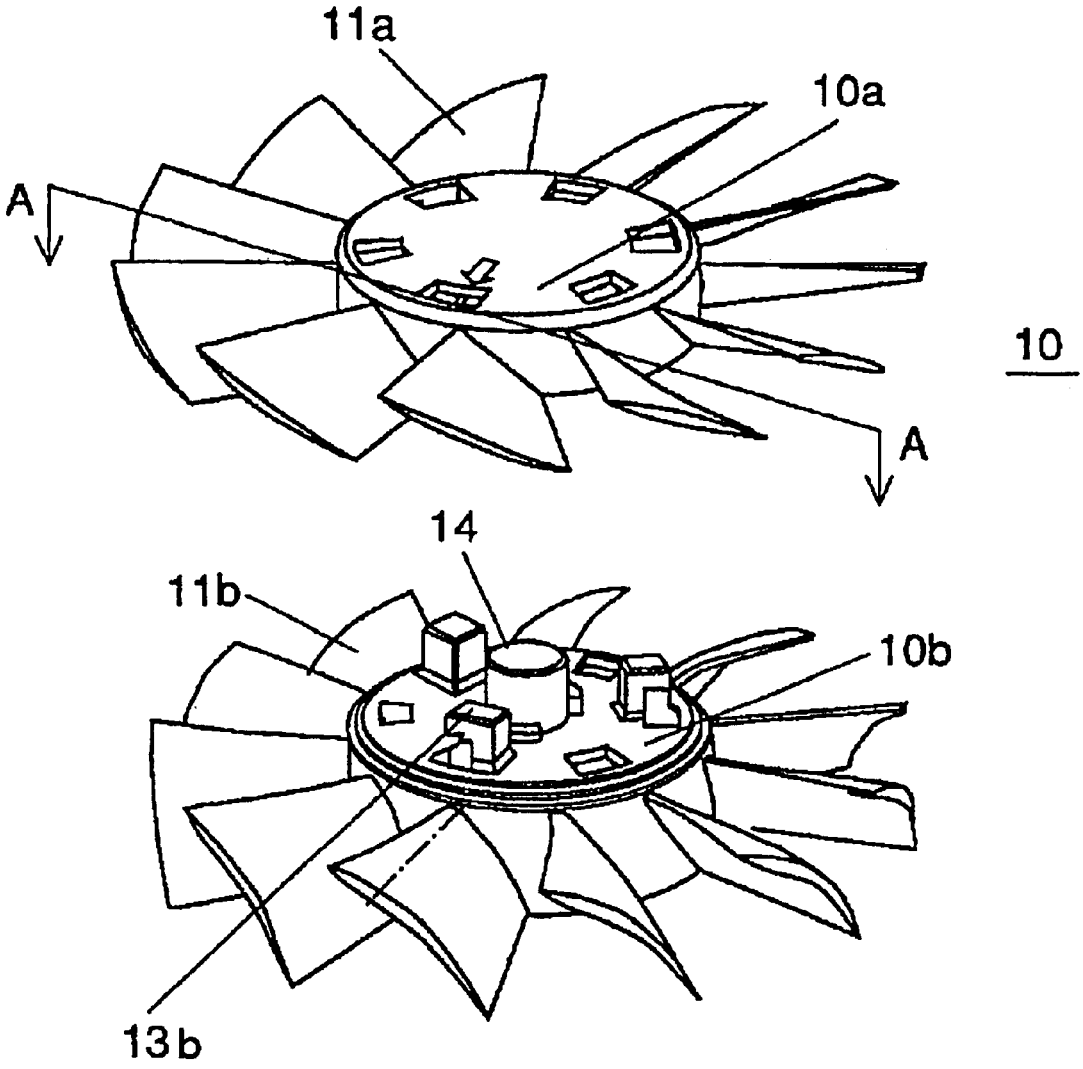
FIG. 4 is an exploded perspective view of the impeller of the light shield cooling fan.
Figure 5:
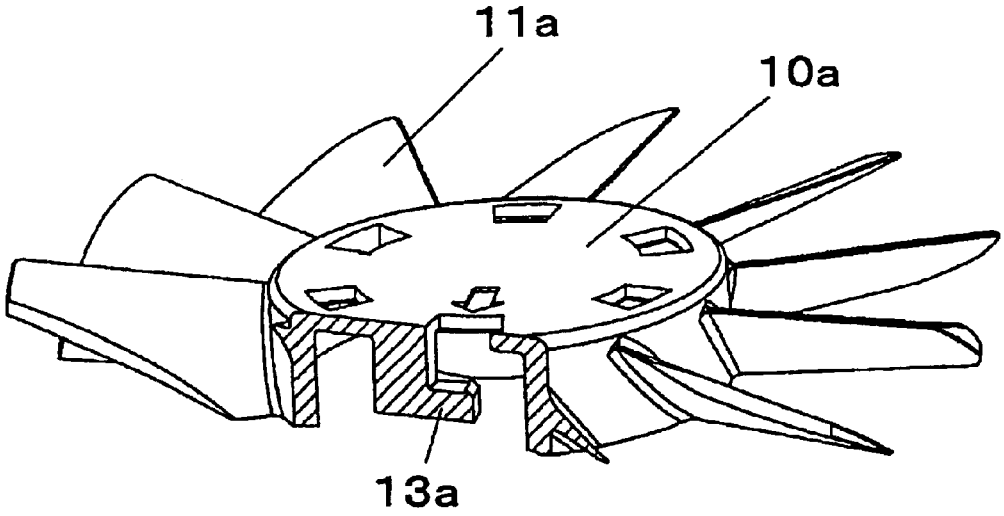
FIG. 5 is a cross-sectional view showing a front stage impeller of the light shield cooling, sectioned along the line A—A of FIG. 4.
Figure 6:
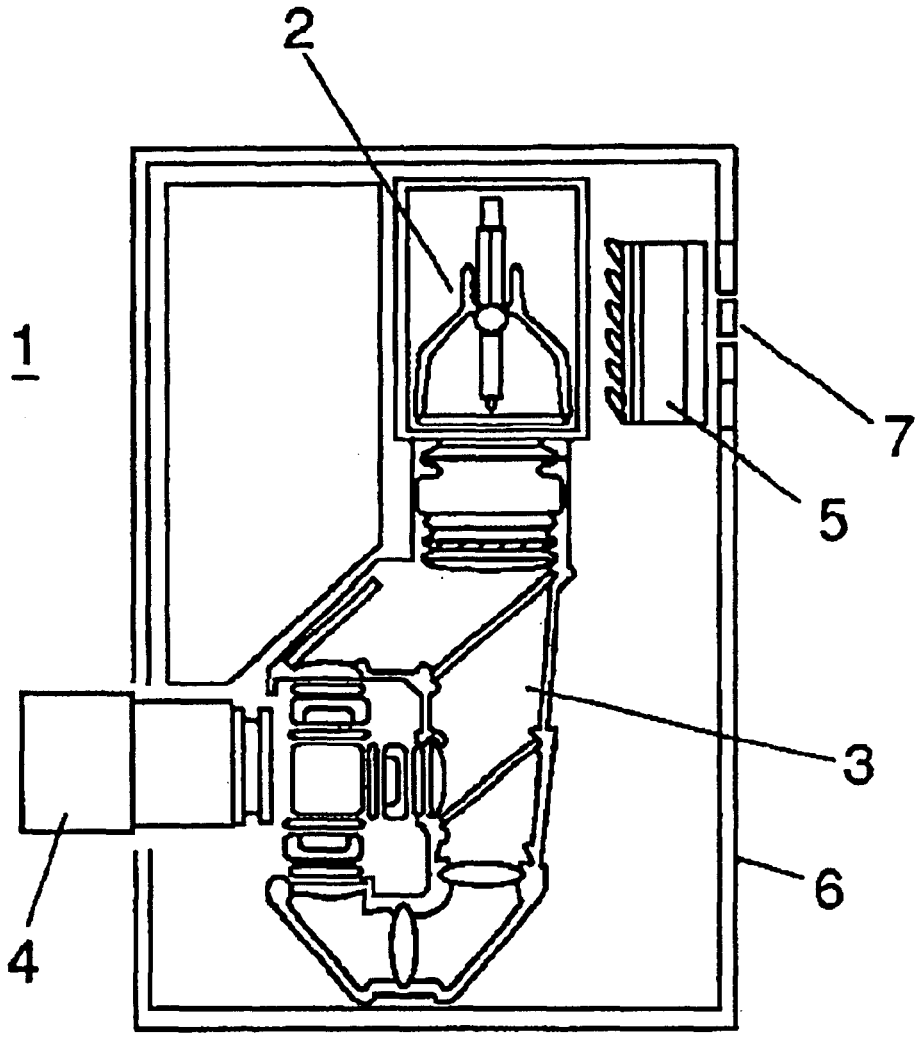
FIG. 6 is a cross-sectional view showing an outline of a conventional projector.
Figure 7:
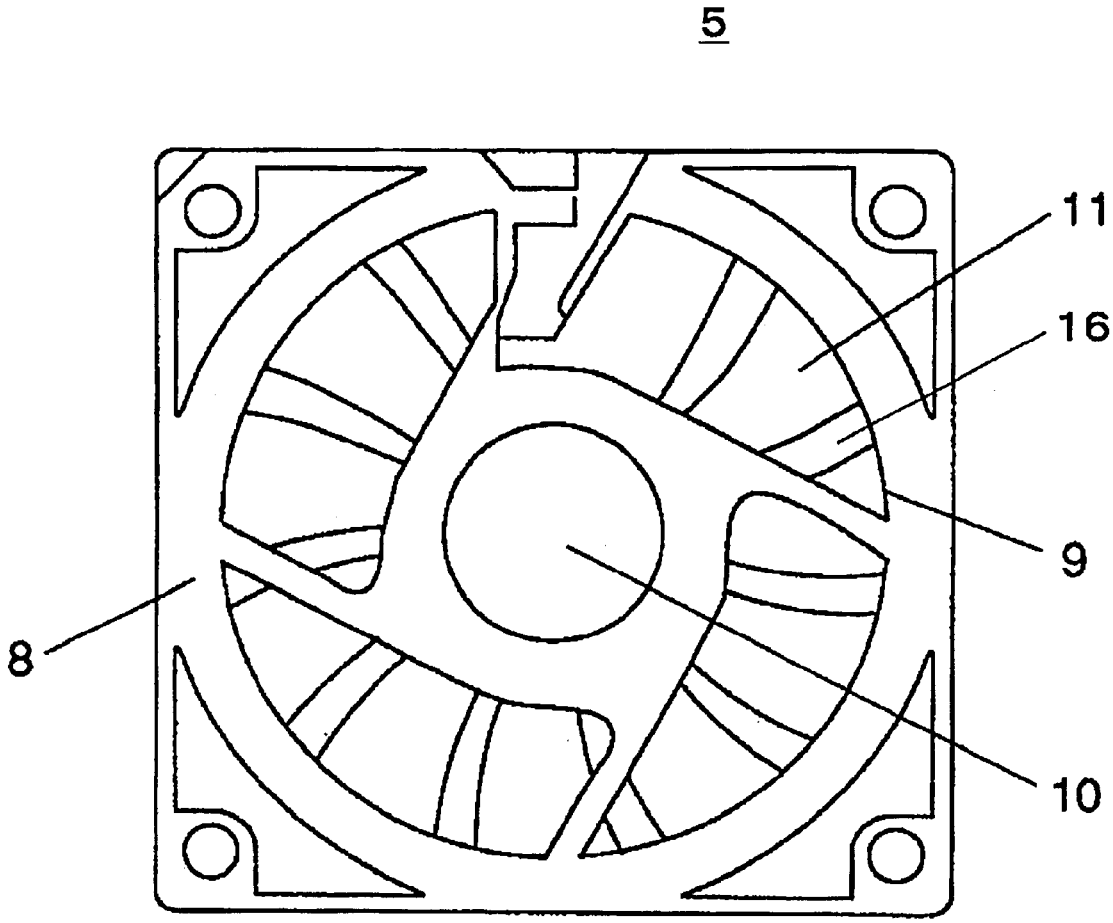
FIG. 7 is a plan view showing a conventional cooling fan used in the conventional projector.
Figure 8:
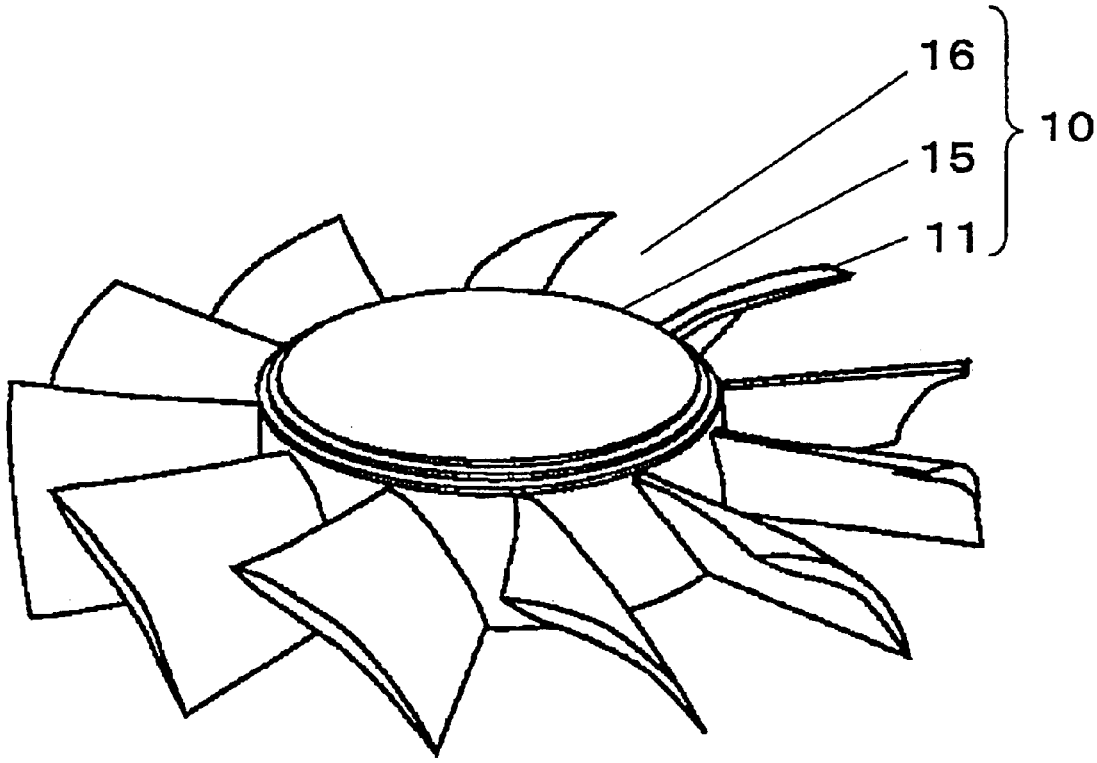
FIG. 8 is a perspective view of an impeller of the conventional cooling fan.

FIG. 1 is a perspective view of the light shield fan in an exemplary embodiment of the present invention. FIG. 2 is a cross-sectional view of the light shield fan. FIG. 3 is a perspective view of an impeller of the light shield fan. FIG. 4 is an exploded perspective view of the impeller. FIG. 5 shows front stage impeller sectioned along the line A—A of FIG. 4. In the above drawings, constituent parts identical to those in the conventional light shield fan are represented by using the same symbols.

As shown in FIG. 1 and FIG. 2, the light shield fan in accordance with the exemplary embodiment of the present invention comprises an impeller 10 and a motor 12 disposed in an opening 9 of a housing 8. The impeller 10 is rotated by the motor 12. The opening 9 for the impeller 10 refers to an inner circumference of the housing 8 surrounding the entire outer circumference of the impeller 10 so as to make contact with the air flow caused by rotation of the impeller 10. The front portion of the opening 9 is the portion of the opening 9 closer to the light source from which the light beam to be shielded by the present cooling fan comes. In other word, the front portion is the portion of the opening 9 at which the intake side blades are disposed. Whereas, the rear portion of the opening 9 is the portion opposite to the front portion, or the portion at which the exhaust side blades are disposed. There is a clearance provided between the inner wall surface of the opening 9 and the impeller 10 for allowing the impeller to rotate. However, an inner diameter at the rear edge (or at the rear portion) is narrowed due to a sloped surface or a stepped shape to be smaller than the inner diameter at the front edge (or at the front portion), so that the inner diameter at the rear portion is at least 50% of that at the front. Furthermore, the rearmost edge of the opening is located further inwardly than an outer edge of a blade 11 towards an axis of the impeller 10 so that the inner diameter at the rearmost edge is smaller than the greatest outer diameter of the blade 11. This is because the present light shield cooling fan may block the entirety of the light beams when it is installed with the fan axis dislocated from the light source.

The impeller 10 consists of a front stage impeller 10*a* and a rear stage impeller 10*b*, as shown in FIG. 3. Describing the impeller 10 in more detail, the front stage impeller 10*a* and the rear stage impeller 10*b* comprise, respectively, a plurality of front stage blades 11*a* and a plurality of rear stage blades 11*b*, all of which protrude radially from the boss portion 15. The rear stage impeller 10*b* is provided at a top plate of the boss portion 15 with a plurality of hooking pieces 13*b* and a center guide pin 14, as shown in FIG. 4, and the front stage impeller 10*a* is provided at a top plate with a plurality of hooking pieces 13*a* and a coupling hole 17 to be engaged with the center guide pin, as shown in FIG. 5. The front stage impeller 10*a* is stacked on the rear stage impeller 10*b*, with the center guide pin 14 inserted in the coupling hole and the hooking pieces 13*b* engaged with the hooking pieces 13*a*. The front stage impeller 10*a* and the rear stage impeller 10*b* are integrated to form a single component, after either one of the impellers is turned to cause the hooking pieces 13*a* and 13*b* to become engaged.

The blades 11*b* of the rear stage impeller 10*b* are intended mainly to circulate the air. So, they have slightly curved shapes for circulating the air with high efficiency. There are gaps between the adjacent blades 11*b*. On the other hand, each of the blades 11*a* of the front stage impeller 10*a* is designed to block light and, therefore, has an almost flat shape. After the front stage impeller 10*a* and the rear stage impeller 10*b* are integrated together, as shown in FIG. 3, each blade 11*a* of the front stage impeller 10*a* overlaps at both sides 31*b* and 31*c* with the adjacent blades 11*b* and 41*b* of the rear stage impeller 10*b* (likewise, a blade 32*a* overlaps at both sides 32*b* and 32*c* with the adjacent blades 41*b* and 42*b* of the rear stage impeller 10*b*). Under the above-described arrangement, the gaps between the blades 11*b* of the rear stage impeller 10*b*, which function mainly to send the air, are optically shielded in a manner whereby the blades of the front stage impeller 10*a* and of the rear stage impeller 10*b* act as light shielding blades.

The front stage impeller 10*a* and the rear stage impeller 10*b* are made of highly temperature-resistant resin such as polybutylene terephthalate (PBT), for example. A carbon material is mixed in the resin to increase total strength and to suppress the light reflection.

The light shield cooling fan of the present invention having the above-described configuration is mounted in a projector at a location behind a light source lamp unit, as described earlier in the background of the invention.

In the light shield cooling fan of the present invention, each of the blades 11*a* of front stage impeller 10*a* overlaps at both sides with the adjacent blades 11*b* of the rear stage impeller 10*b* to optically block the gap between the adjacent blades 11*b* of the rear stage impeller 10*b*. Namely, the light beams coming from the front are bladed by the blades. Thus, the light shield cooling fan offers quite an advantage when used in a projector or the like apparatus incorporating a light source. Furthermore, the opening 9 provided for the impeller is narrowed in inner diameter with a sloped surface or a stepped shape so that the inner diameter at the rear portion is at least 50% of that at the front portion and the rearmost edge of the opening is located further radially inwardly than outer edges of the blades 11 towards the axis of the impeller 10 so that the inner diameter at the rearmost edge is smaller than the greatest outer diameter of the blades 11. Therefore, the light shield cooling fan also blocks the front incident light at the outer circumference region of the blades. Thus the light shield cooling fan offers an outstanding advantage when it is used in a projector or the like apparatus incorporating a light source.

Although the blades 11*a* of the front stage impeller and the blades 11*b* of the rear stage impeller are overlapped for blocking the light beams, the impeller 10 can be manufactured easily by a molding process because it is split into a front stage impeller 10*a* and a rear stage impeller 10*b* such that each individual impeller can be released easily from the dies after molding. This provides an advantage in the manufacture of the fan. The front stage impeller 10*a* and the rear stage impeller 10*b* can be readily integrated into a single component by means of the hooking pieces 13*a* and 13*b*. Therefore, the two piece impeller may be used in the cooling fan without any disadvantage.

The front stage impeller and the rear stage impeller may be integrated together by means of adhesion, welding, riveting, bolting, etc., instead of the above-described hooking pieces 13*a*, 13*b*.

Although the foregoing description of the cooling fan in the present invention are based on an application of the fan in a projector, the fan may of course be used for cooling of other kinds of apparatus having a light source. Furthermore, since the present fan has a structure that prevents viewing therethrough, it may be used as an exhaust fan in an apparatus whose inside should preferably be concealed, for example, a desktop PC. Although the impeller body in the foregoing description has been split into two pieces, it may be provided instead in the form of a single piece body, in so far as the front stage blades and the rear stage blades are disposed in an overlapped configuration so that the blades altogether block the light.

As is clear from the foregoing description, a light shield fan according to the present invention, in which the blades in one of the stages are overlapped with the gaps formed between the adjacent blades in another stage, blocks light beams coming from the front from shining through the gaps.

Furthermore, in the present invention, since the blades are provided in two stages, the front and the rear stages, and a blade in the front stage overlaps with adjacent blades of the rear stage impeller, it not only blocks the light from the front but it also maintains a superior characteristic in circulating the air.

Furthermore, since the impeller of the present invention is formed of the front stage impeller and the rear stage impeller each having a plurality of blades, and the front and rear stage impellers are arranged to be coupled together in a later process step into a single component using hooking pieces where the blades of one of the stages cancel the gaps of the other stage, each of the individual portions of the impeller can be released easily from the dies after molding and the advantage of having the blades block the light coming from the front is not impaired. Thus the fan maintains a superior air circulating characteristic without causing an increase in the process steps required for manufacture.

Still further, since the opening provided in the housing for the impeller is structured so that the inner diameter decreases towards the rear portion, the light can also be blocked around the outer circumference of the blade region.

The present invention offers a superior light shield cooling fan for use in a projector or the like apparatus incorporating a light source. The cooling fan is capable of blocking the light and having a superior air circulating characteristic, and can be manufactured through easy process steps.

What is claimed is:

1. A light shield fan for use in exhausting air from an apparatus, said light shield fan comprising:

a housing impeller part having an impeller opening;

an impeller disposed in said impeller opening to exhaust air through said impeller opening from a first side of said housing impeller part to a second side of said housing impeller part;

an impeller motor coupled with said impeller;

wherein said impeller comprises a plurality of circumferentially arranged impeller blades;

wherein said impeller blades are disposed in an overlapping arrangement as viewed from said second side so as to form a light shield to block light beams incident on said impeller from said first side;

wherein said plurality of impeller blades comprises a plurality of circumferentially arranged first stage impeller blades, and a plurality of circumferentially arranged second stage impeller blades, said second stage impeller blades being disposed nearer to said second side of said impeller part than said first stage impeller blades;

wherein each of said second stage impeller blades has a curved shape, and gaps are present between adjacent blades of said second stage impeller blades when viewed from said second side of said housing impeller part;

wherein each of said first stage impeller blades has a flatter shape than said curved shape of said second stage impeller blades; and wherein, as viewed from said second side of said housing impeller part, each of said first stage impeller blades is arranged to overlap with both blades of an adjacent pair of said second stage impeller blades so as to cover said gaps and thereby block light beams incident upon said impeller from said first side of said housing impeller part.

2. The light shield fan according to claim 1, wherein said impeller comprises a first stage impeller including said first stage impeller blades, and a second stage impeller including said second stage impeller blades; and said first and second stage impeller are separate pieces.

3. The light shield fan according to claim 2, wherein one of said first and second stage impellers includes a hooking piece, and the other of said first and second stage impellers includes a hooking piece engaging part; and said hooking piece and said hooking piece engaging part are engaged with each other such that said first and second stage impellers are integrated into a single component.

4. The light shield fan according to claim 1, wherein said impeller opening of said housing impeller part has a first inner diameter at a first location, and a second inner diameter at a second location nearer to said second side of said housing impeller part than said first location; and said second inner diameter is smaller than said first inner diameter.

5. The light shield fan according to claim 4, wherein said housing impeller part has a circumferential surface defining said impeller opening;

said first location comprises a first edge portion of said circumferential surface; and said second location comprises a second edge portion of said circumferential surface.

6. A light shield fan for use in exhausting air from an apparatus, said light shield fan comprising:

a housing impeller part having an impeller opening;

an impeller disposed in said impeller opening to exhaust air through said impeller opening from a first side of said housing impeller part to a second side of said housing impeller part;

an impeller motor coupled with said impeller;

wherein said impeller comprises a plurality of circumferentially arranged impeller blades;

wherein said impeller blades are disposed in an overlapping arrangement as viewed from said second side so as to form a light shield to block light beams incident on said impeller from said first side;

wherein said plurality of impeller blades comprises a plurality of circumferentially arranged first stage impeller blades, and a plurality of circumferentially arranged second stage impeller blades, said second stage impeller blades being disposed nearer to said second side of said impeller part than said first stage impeller blades;

wherein said impeller comprises a first stage impeller including said first stage impeller blades, and a second stage impeller including said second stage impeller blades;

wherein said first and second stage impellers are separate pieces;

wherein said impeller opening of said housing impeller part has a first inner diameter at a first location, and a second inner diameter at a second location nearer to said second side of said housing impeller part than said first location; and wherein said second inner diameter is smaller than said first inner diameter.

7. The light shield fan according to claim 6, wherein said housing impeller part has a circumferential surface defining said impeller opening, and said circumferential surface comprises a stepped surface arranged so as to make said second inner diameter smaller than said first inner diameter.

8. The light shield fan according to claim 6, wherein said housing impeller part has a circumferential surface defining said impeller opening, and said circumferential surface comprises a sloped surface arranged so as to make said second inner diameter smaller than said first inner diameter.

9. The light shield fan according to claim 6, wherein said second inner diameter is at least 50% of the first inner diameter.

10. The light shield fan according to claim 6, wherein said housing impeller part has a circumferential surface defining said impeller opening;

said first location comprises a first edge portion of said circumferential surface; and said second location comprises a second edge portion of said circumferential surface.

11. A light shield fan for use in exhausting air from an apparatus, said light shield fan comprising:

a housing impeller part having an impeller opening;

an impeller disposed in said impeller opening to exhaust air through said impeller opening from a first side of said housing impeller part to a second side of said housing impeller part;

an impeller motor coupled with said impeller;

wherein said impeller comprises a plurality of circumferentially arranged impeller blades;

wherein said impeller blades are disposed in an overlapping arrangement as viewed from said second side so as to form a light shield to block light beams incident on said impeller from said first side;

wherein said plurality of impeller blades comprises a plurality of circumferentially arranged first stage impeller blades, and a plurality of circumferentially arranged second stage impeller blades, said second stage impeller blades being disposed nearer to said second side of said impeller part than said first stage impeller blades;

wherein said impeller opening of said housing impeller part has a first inner diameter at a first location, and a second inner diameter at a second location nearer to said second side of said housing impeller part than said first location; and wherein said second inner diameter is smaller than said first inner diameter.

12. The light shield fan according to claim 11, wherein said housing impeller part has a circumferential surface defining said impeller opening; said first location comprises a first edge portion of said circumferential surface; and said second location comprises a second edge portion of said circumferential surface.

13. A light shield fan for use in exhausting air from an apparatus, said light shield fan comprising:

a housing impeller part having an impeller opening;

an impeller disposed in said impeller opening to exhaust air through said impeller opening from a first side of said housing impeller part to a second side of said housing impeller part;

an impeller motor coupled with said impeller;

wherein said impeller comprises a plurality of circumferentially arranged impeller blades;

wherein said impeller blades are disposed in an overlapping arrangement as viewed from said second side so as to form a light shield to block light beams incident on said impeller from said first side;

wherein said impeller opening of said housing impeller part has a first inner diameter at a first location, and a second inner diameter at a second location nearer to said second side of said housing impeller part than said first location; and wherein said second inner diameter is smaller than said first inner diameter.

14. The light shield fan according to claim 13, wherein said housing impeller part has a circumferential surface defining said impeller opening;

said first location comprises a first edge portion of said circumferential surface; and said second location comprises a second edge portion of said circumferential surface.

15. A light shield fan arrangement for use in exhausting air from an apparatus having a light source, said light shield fan arrangement comprising:

a housing for holding the apparatus, said housing having an interior, an exterior and an impeller opening communicating the interior of said housing with the exterior of said housing;

an impeller disposed in said impeller opening to exhaust air through said impeller opening from the interior of said housing to the exterior of said housing;

an impeller motor coupled with said impeller;

wherein said impeller comprises a plurality of circumferentially arranged impeller blades;

wherein said impeller blades are disposed in an overlapping arrangement as viewed from the exterior of said housing so as to form a light shield to block light beams incident on said impeller from the interior of said housing;

wherein said plurality of impeller blades comprises a plurality of circumferentially arranged first stage impeller blades, and a plurality of circumferentially arranged second stage impeller blades, said second stage impeller blades being disposed nearer to the exterior of said housing than said first stage impeller blades;

wherein each of said second stage impeller blades has a curved shape, and gaps are present between adjacent blades of said second stage impeller blades when viewed from the exterior of said housing;

wherein each of said first stage impeller blades has a flatter shape than said curved shape of said second stage impeller blades; and wherein, as viewed from the exterior of said housing, each of said first stage impeller blades is arranged to overlap with both blades of an adjacent pair of said second stage impeller blades so as to cover said gaps and thereby block light beams incident upon said impeller from the interior of said housing.

16. The light shield fan arrangement according to claim 15, wherein said impeller comprises a first stage impeller including said first stage impeller blades, and a second stage impeller including said second stage impeller blades; and said first and second stage impeller are separate pieces.

17. A light shield fan arrangement for use in exhausting air from an apparatus having a light source, said light shield fan arrangement comprising:

a housing for holding the apparatus, said housing having an interior, an exterior and an impeller opening communicating the interior of said housing with the exterior of said housing;

an impeller disposed in said impeller opening to exhaust air through said impeller opening from the interior of said housing to the exterior of said housing;

an impeller motor coupled with said impeller;

wherein said impeller comprises a plurality of circumferentially arranged impeller blades;

wherein said impeller blades are disposed in an overlapping arrangement as viewed from the exterior of said housing so as to form a light shield to block light beams incident on said impeller from the interior of said housing;

wherein said impeller opening has a first inner diameter at a first location, and a second inner diameter at a second location nearer to the exterior of said housing than said first location; and wherein said second inner diameter is smaller than said first inner diameter.

* * * * *